US007654514B2

(12) United States Patent
Milillo

(10) Patent No.: US 7,654,514 B2
(45) Date of Patent: Feb. 2, 2010

(54) HIGH CAPACITY TANDEM STACK SHUTTLE FEEDER MODULE

(75) Inventor: William D Milillo, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 76 days.

(21) Appl. No.: 11/943,000

(22) Filed: Nov. 20, 2007

(65) Prior Publication Data

US 2009/0127767 A1 May 21, 2009

(51) Int. Cl.
*B65H 3/44* (2006.01)

(52) U.S. Cl. ..... 271/9.07; 271/9.08; 271/9.12; 271/97; 271/98; 271/105

(58) Field of Classification Search ..... 271/9.07, 271/9.08, 97, 98, 105, 9.12, 147, 148, 158, 271/159

See application file for complete search history.

(56) References Cited

U.S. PATENT DOCUMENTS 2,352,088 A * 6/1944 Evans ..... 271/9.07
3,890,185 A * 6/1975 Umazume ..... 156/299
4,688,782 A * 8/1987 Browne ..... 271/9.07
5,222,860 A * 6/1993 Kamath et al. ..... 414/795.8
6,238,175 B1 * 5/2001 Gotz et al. ..... 414/795
6,685,181 B2 * 2/2004 Bakodledis ..... 271/9.03
6,978,716 B2 * 12/2005 Takeda ..... 101/477
7,051,653 B2 * 5/2006 Ono ..... 101/477
2001/0017441 A1 * 8/2001 Yamaguchi et al. ..... 271/94
2002/0140157 A1 * 10/2002 Moore et al. ..... 271/107

* cited by examiner

*Primary Examiner*—Patrick H Mackey
*Assistant Examiner*—Jeremy Severson
(74) *Attorney, Agent, or Firm*—Lloyd F. Bean, II

(57) ABSTRACT

A sheet feeding apparatus for feeding a stack of sheets in a direction of movement to a process station, including: an elevator tray for holding stacks of sheets; a feed head for picking up a sheet from the stack of sheets when a vacuum force; air knife for blowing air between individual sheets in the stack of sheets, the sheet feeding apparatus having a first mode of operation for feeding a single stack of sheets from the sheet tray and a second mode of operation for feeding first stack of sheets and a second stack of sheets from the elevator tray.

12 Claims, 3 Drawing Sheets

HIGH CAPACITY TANDEM STACK SHUTTLE FEEDER MODULE

This invention relates generally to an electronic reprographic printing system, and more particularly concerns a substrate feeding module having increase versatility that can feed one large sized shack of sheets in one mode or two smaller sized shack of sheets in another mode.

In a typical electrostatographic reproduction process machine, a photoconductive member is charged to a substantially uniform potential so as to sensitize the surface thereof. The charged portion of the photoconductive member is imagewise exposed in order to selectively dissipate charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. With the advent of high speed xerography reproduction machines wherein copiers or printers can produce at a rate in excess of three thousand copies per hour, the need for sheet handling system to, for example, feed paper or other media through each process station in a rapid succession in a reliable and dependable manner in order to utilize the full capabilities of the reproduction machine. These sheet handling systems must operate flawlessly to virtually eliminate risk of damaging the recording sheets and generate minimum machine shutdowns due to misfeeds or multifeeds. It is in the initial separation of the individual sheets from the media stack where the greatest number of problems occur which, in some cases, can be due to up curl and down curl in sheets which generally occur randomly in the document stack.

It is also desirable to have a substrate feeding module that enables media versatility from A5 to legal and allows enhance productivity and sheet capacity for letter/A4 size to increase the time before it is necessary to add paper which is simple-to switch from one paper size to another without appreciably increasing the overall feeding module footprint.

SUMMARY

There is provided a sheet feeding apparatus for feeding a stack of sheets in a direction of movement to a process station, including: an elevator tray for holding stacks of sheets; a feed head for picking up a sheet from said stack of sheets when a vacuum force; air knife for blowing air between individual sheets in said stack of sheets, said sheet feeding apparatus having a first mode of operation for feeding a single stack of sheets from said sheet tray and a second mode of operation for feeding first stack of sheets and a second stack of sheets from said elevator tray.

There is also provided a substrate feeding module that utilizes one shuttle feed head to feed alternately from two adjacent paper stacks residing in the same paper drawer. This invention makes use of the space normally not utilized when an A3 or larger sized paper drawer is filled with letter size or smaller substrates. It also allows for significantly lower manufacturing cost since one feed head is being shared for two stacks. This invention will enable double sheet capacity for letter/A4 sized (or smaller) substrates when feeding from an A3/11"×17" or larger paper drawer without appreciably increasing the overall feeding module footprint.

BRIEF DESCRIPTION OF THE DRAWINGS

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
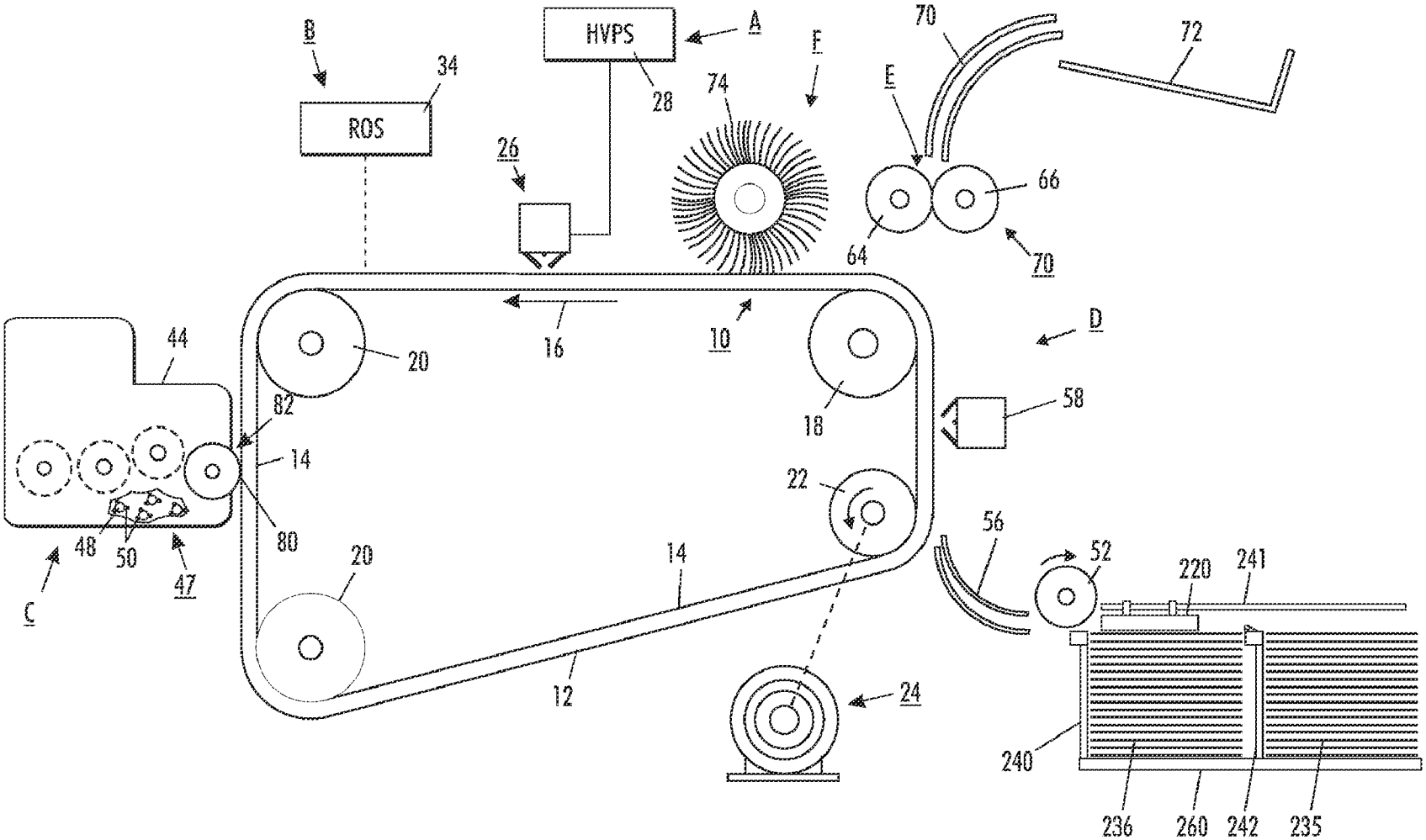

Referring initially to FIG. 3, there is shown an illustrative electrophotographic printing machine incorporating a substrate feeding module of the present disclosure. The printing machine incorporates a photoreceptor 10 in the form of a belt having a photoconductive surface layer 12 on an electroconductive substrate 14. Preferably, the surface 12 is made from a selenium alloy or a suitable photosensitive organic compound. The substrate 14 is preferably made from a polyester film such as Mylar® (a trademark of DuPont (UK) Ltd.) which has been coated with a thin layer of aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, electrical potential. A high voltage power supply 28 is coupled to device 26.

Next, the charged portion of photoconductive surface 12 is advanced through exposure station B. At exposure station B, the ROS 34 lays out the image in a series of horizontal scan lines with each line having a specified number of pixels per inch. The ROS includes a laser and a rotating polygon mirror block associated therewith. The ROS exposes the charged photoconductive surface of the printer.

Figure 1:
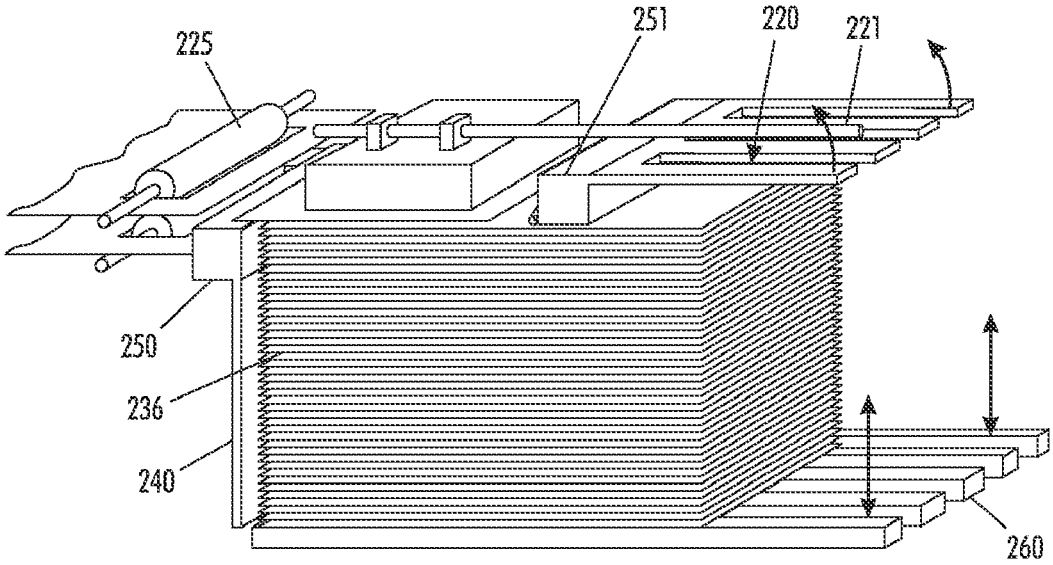
FIG. 1 is a schematic of an example of a digital imaging system, which can employ the substrate feeding module of the present disclosure.

After the electrostatic latent image has been recorded on photoconductive surface 12, the motion of the belt 10 advances the latent image to development station C as shown in FIG. 1. At development station C, a development system 38, develops the latent image recorded on the photoconductive surface. The chamber in developer housing 44 stores a supply of developer material 47. The developer material 47 may be, as shown in FIG. 1, a two component developer material of at least magnetic carrier granules 48 having toner particles 50 adhering triboelectrically thereto. It should be appreciated that the developer material may likewise comprise a one component developer material consisting primarily of toner particles. Preferably the development system is a hybrid scavengeless development system. In a scavengeless development system, toner is detached from a donor roll0 by applying AC electric field to self-spaced electrode structures (not shown), commonly in the form of wires positioned in the nip between the donor roll 80 and the photoreceptor belt 10 in the case of hybrid scavengeless development or by applying the AC electrical field directly to the donor roll 80 in the case of hybrid jumping development. This forms a toner powder cloud in the nip and the latent image attracts toner particles 50 from the powder cloud thereto.

Again referring to FIG. 3, after the electrostatic latent image has been developed, the motion of the belt 10 advances the developed image to transfer station D, at which a copy sheet 54 is advanced by substrate feeding module 200 to to guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual developer material adhering to photoconductive surface 12 is removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the substrate feeding module of the present disclosure therein.

Further details of the construction and operation of substrate feeding module 200 of the present invention are provided below refer to FIGS. 1 and 2. The sequence of operation of the sheet feeder of the present invention is as follows. Referring to FIG. 1, there is shown substrate feeding module 200 used in a first mode or conventional operation to feed a stack of large sheets such as (i.e. A3/11"×17"). A stack of paper 236 is placed into the elevator paper tray 260. Air knife and fluffer 250 are arranged such that it may inject air between sheets in the stack and on top surface of the sheet to be fed. The air pressure between sheets helps separate sheets, i.e. puff the sheets up. A vacuum from to feeder head 220 pulls the sheet to the feeder head 220 and delivers the sheet to take-away-rolls (TAR) 225.

Figure 2:
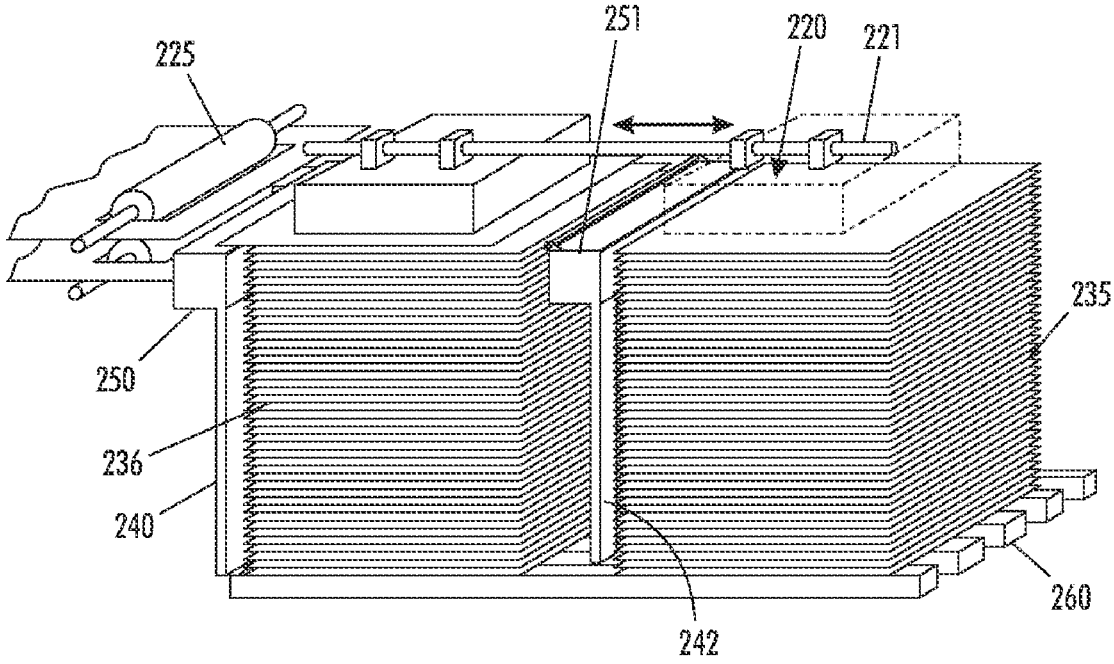
FIGS. 2 and 3 are a schematic of the substrate feeding module employed with the present invention.

Now referring to FIG. 2 there is shown substrate feeding module used in a second mode operation wherein two stacks 235 and 236 of smaller sheets such as A4/LTR are placed on elevator paper tray 120. Air knife and fluffer 250 is arranged such that it may inject air between sheets in stack 236 and on top surface of the sheet to be fed. Air knife and fluffer 251 is arranged such that it may inject air between sheets in stack 235 and on top surface of the sheet to be fed. A vacuum from to feeder head 220 pulls the sheet to the feeder head 220 then moves sheet to take-away-rolls (TAR) 225.

The lead edge wall 240 is the guide for stack 251 which is the front wall of the paper drawer or tray. Air knife and fluffer 251 can be located behind the stacks and mounted to the back or inboard wall of the drawer; or pivotally lowered in place from position shown in FIG. 1 to the enabled position shown in FIG. 2. Air knife and fluffer 251 is mounted to this intermediate wall 242. This intermediate wall 242 is the guide for stack 235.

When feeding letter sized or smaller substrates, feeder head 220 acquires and transport sheets alternately from stack 236 and stack 235 to take-away-rolls (TAR) 225. By alternating the feeding, the stacks are depleted at the same rate thereby maintaining the proper stack height to feed head distance. A controller 250 is coupled to feed head and varying the speed and acceleration of feed head dependent upon at least one predetermined sheet parameter; and wherein: the printing machine has discrete pitch zones; and the controller includes a displacement/velocity profile for the feed head dependent upon how much time is available to bring the sheet to transport speed in a given pitch zone. The feed head displacement/velocity profile is specific to each of the two stacks without creating any skipped pitches when feeding from either stack.

An advantageous feature of the present disclosure is that it enables full use of the normally empty space that exists in large format paper drawers when letter size or smaller sheets are being fed. The footprint of the feeder module is approximately the same as a traditional module with full format size or universal paper drawers, but provides double the letter sized sheet capacity. Unit manufacturing cost for this module is considerably less expensive than those with dedicated feeders per stack since a large percentage of the feeder components (including the blowers and air valves) are shared by the two stacks. This invention offers the customer the option of turning unused drawer space into an extra capacity feature when small paper is used in the large paper drawer.

It is, therefore, apparent that there has been provided in accordance with the present invention a paper preheat transport module that fully satisfies the aims and advantages herein before set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A sheet feeding apparatus for feeding a stack of sheets in a direction of movement to a process station, comprising:

a common elevator tray for holding a first stack of sheets and a second stack adjacent to said first stack of sheets;

a feedhead for picking up a sheet from either said first stack of sheets or said second stack said sheet feeding apparatus having a first mode of operation for picking up sheets solely from said first stack of sheets and a second mode of operation for picking up sheets from both said first stack of sheets and said second stack of sheets.

2. The apparatus of claim 1, further including air knife for blowing air between individual sheets in said first stack of sheets and a second air knife, being retractable for blowing air between individual sheets in said second stack of sheets said second air knife being positioned between said first stack of sheets and said second stack of sheets in said second mode of operation.

3. The apparatus of claim 2, wherein the second air knife is pivotal mounted in said sheet feeding apparatus from an operable position between said first stack of sheets and said second stack of sheets in said second mode of operation, to an inoperable position adjacent to said single stack during said first mode of operation.

4. The apparatus of claim 3, wherein said second air knife includes a front guide, attached to said second air knife, for providing a guide wall for said second stack of sheets.

5. The apparatus of claim 1, wherein said feed head translates to a first position over said first stack of sheets to acquire a sheet from said first stack of sheets and delivers said sheet to said feed rolls, and then said feed head translates to a second position over said second stack of sheets to acquire a sheet from said second stack of sheets and delivers said sheet to said feed rolls during said second mode of operation.

6. The apparatus of claim 1, wherein sheets in said single stack of sheets are dimensionally larger than sheets from said first stack of sheets and said second stack of sheets.

7. A printing machine having a sheet feeding apparatus for feeding a stack of sheets in a direction of movement to a process station, comprising:

A common elevator tray for holding a first stack of sheets and a second stack adjacent to said first stack of sheets;

a feedhead for picking up a sheet from either said first stack of sheets or said second stack;

said sheet feeding apparatus having a first mode of operation for picking up sheets solely from said first stack of sheets and a second mode of operation for picking up sheets from both said first stack of sheets and said second stack of sheets.

8. A printing machine having an apparatus of claim 7, further including air knife for blowing air between individual sheets in said first stack of sheets and a second air knife, being retractable for blowing air between individual sheets in said second stack of sheets said second air knife being positioned between said first stack of sheets and said second stack of sheets in said second mode of operation.

9. A printing machine having an apparatus of claim 8, wherein the second air knife is pivotal mounted in said sheet feeding apparatus from an operable position between said first stack of sheets and said second stack of sheets in said second mode of operation, to an inoperable position adjacent to said single stack during said first mode of operation.

10. A printing machine having an apparatus of claim 9, wherein said second air knife includes a front guide, attached to said second air knife, for providing a guide wall for said second stack of sheets.

11. A printing machine having an apparatus of claim 7, wherein said feed head translates to a first position over said first stack of sheets to acquire a sheet from said first stack of sheets and delivers said sheet to said feed rolls, and then said feed head translates to a second position over said second stack of sheets to acquire a sheet from said second stack of sheets and delivers said sheet to said feed rolls during said second mode of operation.

12. A printing machine having an apparatus of claim 7, wherein sheets in said single stack of sheets are dimensionally larger than sheets from said first stack of sheets and said second stack of sheets.

* * * * *